US006545414B2

(12) United States Patent
Horiuchi et al.

(10) Patent No.: US 6,545,414 B2
(45) **Date of Patent: *Apr. 8, 2003**

(54) HIGH-PRESSURE DISCHARGE LAMP

(75) Inventors: Makoto Horiuchi, Sakurai (JP); Kiyoshi Takahashi, Neyagawa (JP); Makoto Kai, Katano (JP)

(73) Assignee: Matsushita Electric Industrial Co., Ltd., Osaka-fu (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/157,244

(22) Filed: Sep. 18, 1998

(65) Prior Publication Data

US 2002/0014842 A1 Feb. 7, 2002

(51) Int. Cl.[7] ..... H01J 17/20; H01J 61/20

(52) U.S. Cl. ..... 313/639; 313/631; 313/638; 313/574; 313/573

(58) Field of Search ..... 313/25, 631, 632, 313/634, 636, 326, 327, 329, 332, 335

(56) References Cited

U.S. PATENT DOCUMENTS 3,670,195 A * 6/1972 Kamegaya et al. ..... 313/632
3,868,528 A * 2/1975 Lake et al. ..... 313/332
4,161,672 A * 7/1979 Cap et al. ..... 31/634
4,277,714 A * 7/1981 Keefe et al. ..... 313/628
4,937,495 A * 6/1990 Gosslar et al. ..... 313/631
4,968,916 A * 11/1990 Davenport et al. ..... 313/631
5,004,951 A * 4/1991 Honda et al. ..... 313/631
5,028,843 A * 7/1991 Narita ..... 313/641
5,107,165 A * 4/1992 Dever et al. ..... 313/25
5,357,167 A * 10/1994 Mathews et al. ..... 313/632
5,614,787 A * 3/1997 Kawai et al. ..... 313/623
5,866,981 A * 2/1999 Saimi et al. ..... 313/570
5,905,341 A * 5/1999 Ikeuchi et al. ..... 313/636

* cited by examiner

*Primary Examiner*—Nimeshkumar D. Patel
*Assistant Examiner*—Mariceli Santiago
(74) *Attorney, Agent, or Firm*—Wenderoth, Lind & Ponack, L.L.P.

(57) ABSTRACT

A high-pressure discharge lamp is configured to regulate the relationship between the radius r (mm) of the tungsten rods forming the electrodes and the lamp current I (amperes) using the formula $$1.5 \leq \frac{I}{\pi \cdot r^2} \leq 9$$

when the ratio of the circumference of the circle to its diameter is expressed as π. The high-pressure discharge lamp suppresses early blackening, and achieves a long-life light source.

4 Claims, 2 Drawing Sheets

HIGH-PRESSURE DISCHARGE LAMP

BACKGROUND OF THE INVENTION

1. Field of the Invention

The present invention relates to a high-pressure discharge lamp, which exhibits little blackening.

2. Description of the Related Art

In general, a high-pressure discharge lamp is a light source, which provides a pair of electrodes inside a translucent quartz arc tube filled with a noble gas for starting, and mercury or another metallic halogen compound, and which is designed so that an arc discharge is generated by applying voltage to both electrodes and creating a current. This arc discharge illuminates the filling substance, enabling the high-pressure discharge lamp to be widely used as ordinary lighting, or as lighting for such equipment as an overhead projector (OHP).

A metallic halogen compound-filled metal halide lamp features especially high efficiency and high color rendering capabilities. For this reason, it has recently come into widespread use in combination with a reflecting mirror in liquid crystal projectors and other such image projecting devices. And for this type of metal halide lamp, as disclosed in Japanese Patent Laid-Open Publication No. 3-219546, for example, an iodide of neodymium (Nd), dysprosium (Dy) and cesium (Cs) is generally used as the metallic halogen compound contained in the arc tube.

A lamp containing an iodide of neodymium (Nd), dysprosium (Dy) and cesium (Cs) (hereafter referred to as a Dy—Nd—Cs—I lamp) features outstanding luminous efficacy and color rendering, color temperature, but due to the strong reaction between neodymium (Nd) and the quartz in the arc tube, devitrification of the arc tube occurs during early life. Because this type of devitrification decreases luminous flux, reduces luminance and causes light to diffuse, it brings about uneven illuminance and reduced brightness in a liquid crystal projector screen. That is, when a Dy—Nd—Cs—I lamp is used as the light source in a liquid crystal projector, good light generation characteristics are achieved, but the drawback is short lamp life.

To counter this, as is disclosed in Japanese Patent Laid-Open Publication No. 2-186552, a method for filling the arc tube with lutetium (Lu), which does not readily react with quartz, has already been reported. That is, devitrification can be decreased and a metal halide lamp with good light generating characteristics can be achieved by filling an arc tube with mercury and noble gas, and between $2\times10^{-7}$ mol/cc and $2\times10^{-5}$ mol/cc of lutetium (Lu) together with halogen.

Recently, because metal halide lamps used in liquid crystal projectors and other image projection devices are being combined with optical systems, which utilize liquid crystals, it is desirable to enhance optical efficiency by further shortening the arc length (distance between electrodes).

However, when the arc length is shortened, the thermal burden on the electrodes increases, giving rise to early blackening of the arc tube, and causing a dramatic drop in the luminous flux maintenance factor. That is, a lamp with a short arc length is disadvantageous in that the arc tube blackens and luminous flux decreases even sooner than with the arc tube devitrification phenomenon, even when filled with a substance that does not readily react with quartz.

SUMMARY OF THE INVENTION

An object of the present invention is to solve for this problem by providing a high-pressure discharge lamp that exhibits little blackening.

To achieve the above-mentioned object, the present invention is a high-pressure discharge lamp, which comprises a pair of electrodes that are separated from one another by a predetermined distance, and which is lighted by a reverse polarity power source, wherein this high-pressure discharge lamp is designed to satisfy a relationship whereby $$1.5 \le \left(\frac{I}{\pi \cdot r^2}\right) \le 9 \tag{1}$$

when the radius at the tip of each electrode is r(mm), the lamp current at steady discharge is I (amperes), and the ratio of the circumference of the circle to its diameter is $\pi$.

DESCRIPTION OF THE PREFERRED EMBODIMENTS

The following is a detailed description of the embodiments of the present invention based on the figures.

Embodiment 1

Figure 1A:
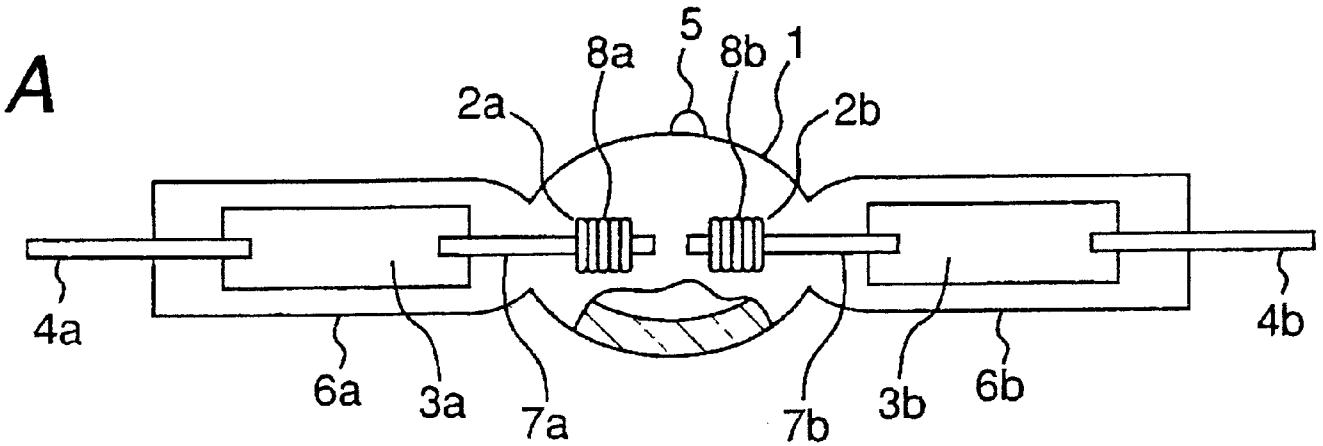
FIG. 1A is a diagram showing a configuration for a metal halide lamp of a first embodiment of the present invention.
Figure 1B:
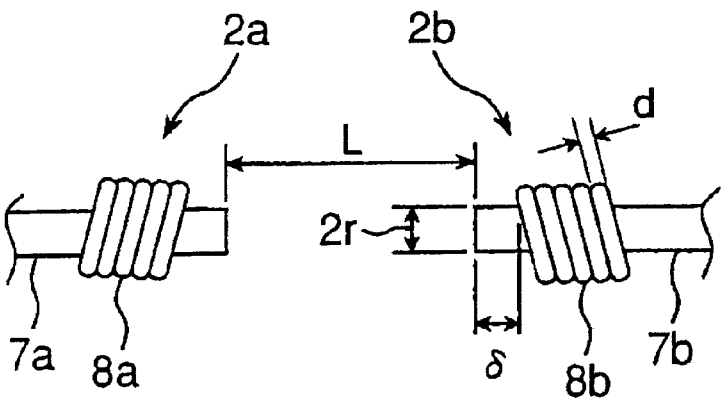
FIG. 1B is an enlarged diagram of the arc discharge portion in FIG. 1A.

FIGS. 1A and 1B show a metal halide lamp of a first embodiment of a high-pressure discharge lamp according to the present invention.

In FIG. 1A, 1 is an arc tube, which is a translucent vessel made of quartz, on both ends of which are formed sealed portions 6*a*, 6*b*. Metal foil conductors made of molybdenum, molybdenum foil 3*a*, 3*b*, are sealed into each of the sealed portions 6*a*, 6*b*, and electrodes 2*a*, 2*b* and molybdenum external lead lines 4*a*, 4*b* are connected electrically to each of these metal foil conductors of molybdenum foil 3*a*, 3*b*.

As best shown in FIG. 1B, the respective electrodes 2*a*, 2*b* are configured from radius r=0.4 mm tungsten rods 7*a*, 7*b*, and coils 8*a*, 8*b* of 5 winds of closely wound tungsten wire having a diameter d=0.3 mm.

The respective coils 8*a*, 8*b* serve as radiators for the electrodes 2*a*, 2*b*, and are affixed electrically by welding to locations at the ends of the tungsten rods 7*a*, 7*b* so that the length of protrusion $\delta$ of the tungsten rods 7*a*, 7*b* from the coils 8*a*, 8*b* becomes roughly 0.8 mm. And the electrodes 2*a*, 2*b* are positioned opposite one another inside the arc tube 1 so that the mutual clearance therebetween, that is, the distance between electrodes L, becomes 3 mm. The arc tube 1 is a truncated spheroid shape, with a maximum inner diameter of 10 mm at the center, and a content volume of 0.7 cc, and as filling, contains 0.4 mg of indium iodide (InI), 1 mg of holmium iodide ($HoI_3$), 35 mg of mercury as a buffer gas, and 15 OTorr of argon as a starting noble gas.

Reverse polarity power was supplied via external lead wires 4*a*, 4*b* to a metal halide lamp configured as above, and life testing was conducted when the arc was in a horizontal state under conditions wherein lamp current was 2.71A (amperes) and lamp input was 200W (watts) during steady discharge, and the luminous flux maintenance factor was checked after 500 hours. For the sake of comparison, the same life testing was performed on a lamp for which the radius of the tungsten rods 7*a,* 7*b* was r=0.27 mm, and the other configurations were the same as the metal halide lamp shown in FIG. 1A (hereinafter called lamp A), and a lamp for which the distance between electrodes L was 7 mm, the radius of the tungsten rods 7*a,* 7*b* was r=0.27 mm, and the other configurations were the same as the metal halide lamp shown in FIG. 1A (hereinafter called lamp B).

The results were that, after 500 hours, the lamp configured as shown in FIG. 1A, and lamp B exhibited little blackening of the arc tube and devitrification phenomenon, and the luminous flux maintenance factors thereof were also good. However, the blackening of lamp A was intense even though there was no devitrification of the arc tube.

From the results obtained from lamp A and lamp B, it is clear that blackening becomes intense when the arc length is shortened. The reason for this is because when the distance between the electrodes was shortened, and the lamps were lighted using the same lamp input, the power inputted per unit arc length increased, thereby raising the arc temperature, and increasing the heat transmitted to the electrodes 2*a,* 2*b* from the arc via radiation and conduction. As a result thereof, the thermal burden on the electrodes 2*a,* 2*b* increased, the temperature rose, and the diffusion of the tungsten, which comprises the electrodes 2*a,* 2*b,* became animated. Conversely, the lamp configuration of this embodiment shown in FIGS. 1A and 1B can be said to have electrodes 2*a,* 2*b* capable of withstanding increased thermal burden. In the case of the lamp configuration of FIGS. 1A and 1B, the equation becomes, $$\frac{I}{\pi \cdot r^2} = \frac{2.71}{\pi \cdot 0.4^2} = 5.4 \ (\pi = 3.14)$$

and this value satisfies formula (1) above.

Meanwhile, for lamp A, the equation becomes $$\frac{I}{\pi \cdot r^2} = \frac{2.71}{\pi \cdot 0.27^2} = 11.8 \ (\pi = 3.14)$$

and this value does not satisfy formula (1) above.

The results of testing conducted to find the range of preferred electrode shapes is described next. The lamps utilized in the testing were metal halide lamps with the same configuration as the lamp shown in FIGS. 1A and 1B. Only the structure of the electrodes 2*a,* 2*b* and the distance between electrodes L thereof were changed to study the effects on life characteristics. The contents and results of these tests are shown in (Table 1). The factors varied in the electrode structure of 2*a,* 2*b* were the radius r(mm) of the tungsten rods 7*a,* 7*b,* and the diameter d(mm) of the tungsten wire comprising the coils 8*a,* 8*b*. Evaluations were determined by the degree of blackening of the arc tube following 500 hours of lighting. The length of protrusion δ of the tungsten rods 7*a,* 7*b* from the coils 8*a,* of windings of the coils 8*a,* 8*b,* and the lighting conditions (lamp input) were the same as for the above embodiment.

TABLE 1

| | Lamp No. | Tungsten Rod Radius r (mm) | Tungsten Wire Diameter d (mm) | Distance Between Electrodes L (mm) | Evaluation Good = O No Good = X |
|---|---|---|---|---|---|
| Group A | 1 | 0.25 | 0.3 | 3 | X |
| | 2 | 0.31 | 0.3 | 3 | O |
| | 3 | 0.55 | 0.3 | 3 | O |
| | 4 | 0.65 | 0.3 | 3 | O |
| | 5 | 0.75 | 0.3 | 3 | O |
| | 6 | 0.85 | 0.3 | 3 | O |
| Group B | 7 | 0.31 | 0.2 | 3 | O |
| | 8 | 0.31 | 0.4 | 3 | O |
| | 9 | 0.31 | 0.5 | 3 | O |
| | 10 | 0.75 | 0.2 | 3 | O |
| | 11 | 0.75 | 0.4 | 3 | O |
| | 12 | 0.75 | 0.5 | 3 | O |
| Group C | 13 | 0.31 | 0.3 | 1.5 | O |
| | 14 | 0.31 | 0.3 | 4.5 | O |
| | 15 | 0.75 | 0.3 | 1.5 | O |
| | 16 | 0.75 | 0.3 | 4.5 | O |

For Group A (Lamp No. 1–No. 6) in (Table 1), the distance between electrode was fixed at L=3 mm, the diameter of the tungsten wire comprising the fixed at d=0.3 mm, and the radius r of the tungsten rods 7*a,* 8*b* underwent various changes.

The results thereof were that tungsten rods 7*a,* 7*b* with an r of 0.31 mm or larger were good, exhibiting little blackening of the arc tube. By contrast, the r=0.25 mm (No. 1) tungsten rods 7*a,* 7*b* were too thin, diffusion of the tungsten electrode material during use was severe, and there was a marked drop in the luminous flux maintenance factor as a result of blackening.

From these results, it was concluded that the radius r of the tungsten rods 7*a,* 7*b* should be 0.31 mm or larger. However, although this range is good for suppressing blackening, in general, if the radius of the tungsten rods 7*a,* 7*b* is too large, the compressive strength of the sealed portions 6*a,* 6*b* decreases. The compressive strength exhibited by lamps No. 2–No. 6 was measured using a separate test. Those results are shown in (Table 2).

TABLE 2

| | Lamp No. | Tungsten Rod Radius r (mm) | Compressive Strength (Relative Value) With Reference to Lamp No. 2 |
|---|---|---|---|
| Group A | 2 | 0.31 | 1 |
| | 3 | 0.55 | 0.95 |
| | 4 | 0.65 | 0.92 |
| | 5 | 0.75 | 0.80 |
| | 6 | 0.85 | 0.60 |

If we take into consideration the effect that the diameter of the tungsten rods 7*a,* 7*b* has on compressive strength based on the results listed in (Table 2), regulating r within the range of 0.31 mm to 0.80 mm should make it possible to ensure both sufficient compressive strength and adequate suppression of blackening. Even more desirable is a radius between 0.31 mm and 0.75 mm.

Furthermore, since tungsten rods 7*a,* 7*b* within this range are relatively thick, even with the addition/inclusion of bromine, or a metallic bromide, which bonds with low-temperature tungsten and causes tapering at the base of the electrode, electrode tapering is so slight as to not be a problem. Therefore, another effect is obtained, one which enables the addition/inclusion of bromine or a metallic bromide for the purpose of preventing the devitrification of the arc tube 1.

Diffusion of the electrode material is effected not only by the size of the radius r, but also by the lamp current I per unit area during steady discharge. Therefore, if the relationship between the radius r(mm) of the tungsten rods 7*a,* 7*b* and the lamp current I (amperes) is expressed using a general formula, from the above conclusion, it was learned that when the ratio of the circumference of the circle to its diameter is expressed as π, this formula is $$\frac{I}{\pi \cdot r^2} \text{ (lower limit value)} = \frac{2.71}{\pi \cdot 0.75^2} = 1.5$$

$$\frac{I}{\pi \cdot r^2} \text{ (upper limit value)} = \frac{2.71}{\pi \cdot 0.31^2} = 9.0$$

$$\text{so that} \quad 1.5 \le \frac{I}{\pi \cdot r^2} \le 9$$

and the relationship between I and r irrespective of lamp input (watts) can be satisfied as in the above formula.

Next, for Group B (Lamp No. 7–No. 12), the radius r of the tungsten rods 7*a,* 8*b* was set at the lower limit value of 0.31 mm and the upper limit value of 0.75 mm, the range over which the above-mentioned evaluation was good, and the diameter d of the tungsten wire comprising the coils 8*a,* 8*b* underwent various changes.

The results of this were good with blackening also being slight for all lamps (No. 7–No. 12). From this, it was concluded that so long as the diameter d of the tungsten wire comprising the coils 8*a,* 8*b* satisfies the above-described formula (1), there is no particular need for limits.

Next, for Group C (Lamp No. 13–No. 16), the radius r of the tungsten rods 7*a,* 8*b* was set at 0.31 mm and 0.75 mm, the diameter of the tungsten wire comprising the coils 8*a,* 8*b* was fixed at d=0.3 mm, and the distance between electrodes L underwent various changes.

The results were that the life characteristics of all the lamps were good. Therefore, it was learned that if the above-mentioned formula (1) is satisfied regardless of the distance between the electrodes, blackening can be suppressed even in a short-arc-type metal halide lamp wherein the distance between electrodes L is roughly between 1 mm and 5 mm.

Furthermore, if the relationship between the lamp current I and the radius r of the tungsten rods 7*a,* 7*b* is adjusted so as to satisfy the above-mentioned formula (1), needless to say, the blackening suppression effect can be adequately achieved even with a lamp in which the distance between electrodes L is greater than 5 mm.

Furthermore, testing of each of the above-mentioned groups was conducted using the single coil shown in FIG. 1B as the shape of the coils 8*a,* 8*b.* However, when further testing was carried out on a number of these test lamps using multiple windings, for example, double wind coils, or no coils at all, it was learned that the results did not change irrespective of the presence or absence of coils.

That is, lamps that were good with single coils, were also good with multiple coils and no coils, and lamps that were no good with single coils, were also no good with multiple coils and no coils.

Further, if the length of protrusion δ of the tungsten rods 7*a,* 7*b* from the coils 8*a,* 8*b,* and the number of windings of the coils 8*a,* 8*b* satisfied the above-mentioned formula (1), there is no particular need for limits.

From the above results, it was learned that if the radius r(mm) of the tungsten rods 7*a,* 7*b,* and the lamp current I (amperes) satisfy the formula $$1.5 \le \frac{I}{\pi \cdot r^2} \le 9$$

when the ratio of the circumference of the circle to its diameter is expressed by π, a lamp that exhibits little blackening and good life characteristics can be achieved.

Further, the above embodiment was described using horizontal lighting as an example, but the present invention is not limited to this, and perpendicular lighting is also possible. Similarly, the metallic halogen compound filling is also not limited to that used in the above embodiment, and the same effect can be achieved even with halogen compounds such as neodymium (Nd) and cesium (Cs), dysprosium (Dy). Furthermore, the present invention is not limited to a metal halide lamp, and the same effect can be achieved with other high-pressure discharge lamps, such as a high-pressure mercury lamp, and a high-pressure sodium vapor lamp, for example.

Embodiment 2

Figure 2A:
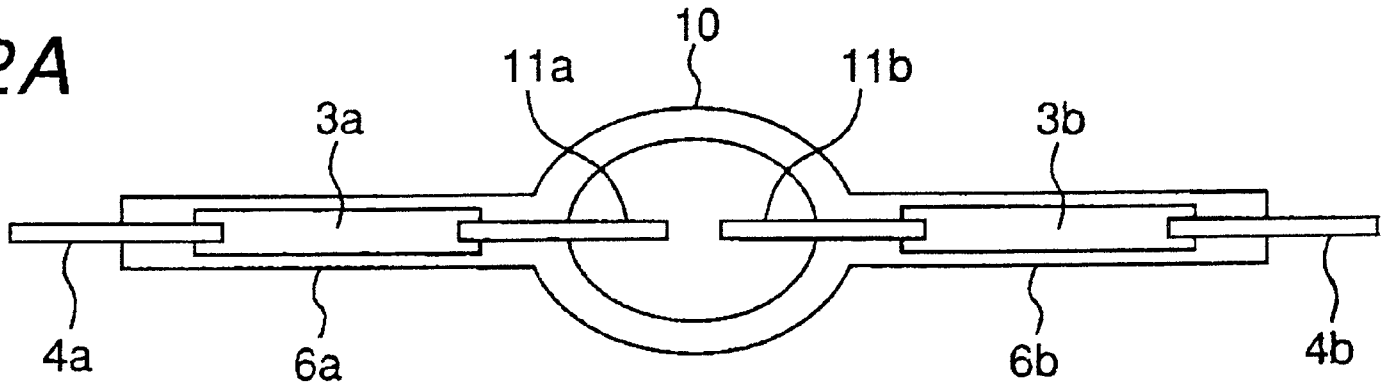
FIG. 2A is a diagram showing a configuration for a high-pressure mercury lamp of a second embodiment of the present invention.
Figure 2B:
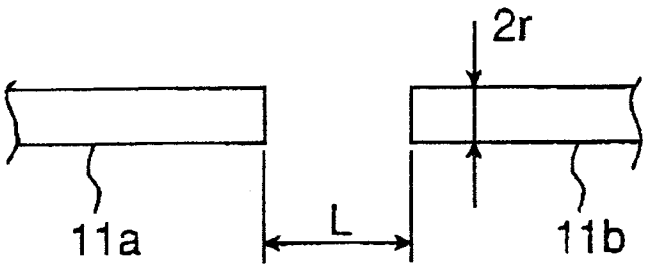
FIG. 2B is an enlarged diagram of the arc discharge portion in FIG. 2A.

FIGS. 2A and 2B show a diagram of a second embodiment of a high-pressure mercury lamp according to the present invention.

In FIG. 2A, 10 is an arc tube, which is a translucent vessel made of quartz, the shape of which is a truncated spheroid, with a maximum inner diameter of 7 mm at the center, and a content volume of 0.25 cc, and as filling, it contains 35 mg of mercury, and roughly 3 atmospheres of xenon gas at room temperature.

As best shown in FIG. 2B, 11*a,* 11*b* are each tungsten rods with a radius of r=0.3 mm, and serve as electrodes. The tungsten rods 11*a,* 11*b* are positioned opposite one another inside the arc tube 10 so that the mutual clearance therebetween, that is, the distance between electrodes L, becomes 1.5 mm. The rest of the configuration is the same as the lamp shown in FIGS. 1A and 1B.

Reverse polarity power was supplied via external lead wires 4*a,* 4*b* to a lamp configured as above, and life testing was conducted when the arc was in a horizontal state under conditions wherein the lamp current I was 1.1A (amperes) and the lamp input was 100W (watts) during steady discharge. For a lamp configured as shown in FIGS. 2A and 2B, the formula becomes $$\frac{I}{\pi \cdot r^2} = \frac{1.1}{\pi \cdot 0.3^2} = 3.9 \ (\pi = 3.14)$$

and this value satisfies formula (1) above. As a result, good life characteristics were achieved without any sign of early blackening of the arc tube 10. Further, for the lamp configuration shown in FIGS. 2A and 2B as well, as a result of pursuing the preferred range of electrode shapes by varying the shape of the electrodes (tungsten rods 11*a,* 11*b*) similar to above, it was confirmed that similar effects are achieved if adjustments are made to satisfy formula (1) above. Furthermore, between 0.1 mg and 1 mg of mercury bromide ($HgBr_2$) was added to a lamp configured as shown in FIG. 2A, and life testing was conducted in the same manner. Good life characteristics were achieved without the occurrence of bromine-induced tapering of the tungsten rods 11*a,* 11*b.*

Further, the lamp was filled with roughly 3 atmospheres of xenon gas at room temperature to increase the light output at initial lighting. Therefore, there is no range limit to the pressure of the lamp, and further, in place of xenon, for example, argon can also be used.

As for the tungsten rods 7*a,* 7*b* and 11*a,* 11*b* in the embodiments described above, in the formation process thereof, the cross-sections of the tungsten rods 7*a,* 7*b,* and 11*a,* 11*b* often become substantially ellipsoidal rather than completely circular. When this happens, the radius r can be considered the average value of the lengths of the major axis and minor axis.

Further, if the tungsten rods 7*a,* 7*b* and 11*a,* 11*b* are comprised of a high-melting-point metallic material, which is superior even to tungsten in electron emissivity, for example, thoriated-tungsten, which contains thorium oxide, the diffusion of the electrode material can be further reduced, and blackening can also be suppressed.

The preferred embodiments of the present invention have been described above, but the present invention is not limited to this description, and numerous variations are possible.

As described above, since the present invention regulates the relationship between the radius of the tips of the electrodes and the lamp current during steady discharge in a high-pressure discharge lamp lighted by a reverse polarity power source, it enables the realization of a long-life, economical lamp, which exhibits little early blackening of the arc tube.

What is claimed is:

1. A high-pressure mercury lamp comprising:

a sealed tube containing at least mercury bromide which generates bromine and mercury bromide, wherein the bromine and the mercury bromide prevent devitrification of said sealed tube; and first and second electrodes extending into said sealed tube and separated from each other by a predetermined distance, said first and second electrodes being adapted to receive power, wherein each of said first and second electrodes has an elongated rod portion having a radius r between 0.31 mm and 0.75 mm and which satisfies the following relationship, $$1.5 \leq \frac{I}{\pi \cdot r^2} \leq 9$$

wherein I is a lamp current discharge.

2. A high-pressure mercury lamp as recited in claim 1, wherein said first and second electrodes are adapted to receive reverse polarity electric power.

3. A high-pressure mercury lamp as recited in claim 1, wherein said first and second electrodes are separated from each other by a predetermined distance between 1 mm and 5 mm.

4. A high-pressure mercury lamp as recited in claim 1, wherein said first and second electrodes comprise tungsten.

* * * * *